United States Patent [19]

Crowell

[11] 4,313,291

[45] Feb. 2, 1982

[54] METHOD FOR REFURBISHING AND PROCESSING PARACHUTES

[75] Inventor: Russell T. Crowell, Titusville, Fla.

[73] Assignee: The United States of America as represented by the Administrator of the National Aeronautics and Space Administration, Washington, D.C.

[21] Appl. No.: 154,663

[22] Filed: May 30, 1980

Related U.S. Application Data

[62] Division of Ser. No. 862,878, Dec. 12, 1977, Pat. No. 4,244,810.

[51] Int. Cl.[3] ..... D06F 31/00

[52] U.S. Cl. ..... 53/429; 8/150

[58] Field of Search ..... 68/3 R, 5 C, 10; 198/473, 477, 678; 8/150; 53/429

[56] References Cited

U.S. PATENT DOCUMENTS

| | | | |
|---|---|---|---|
| 709,639 | 9/1902 | Keith et al. | 198/473 |
| 3,118,531 | 1/1964 | Rutkovsky et al. | 198/678 X |
| 3,192,645 | 7/1965 | Oetjen et al. | 198/678 X |
| 3,550,169 | 12/1970 | Forse | 68/3 R X |
| 3,686,899 | 8/1972 | Rosenfeld et al. | 68/3 R |

*Primary Examiner*—Philip R. Coe

*Attorney, Agent, or Firm*—James O. Harrell; John R. Manning

[57] ABSTRACT

A system and method for refurbishing and processing parachutes is disclosed including an overhead monorail conveyor system on which the parachute is suspended for horizontal conveyance. The parachute is first suspended in partially open tented configuration wherein open inspection of the canopy is permitted to remove debris and inspect all areas. Following inspection, the parachute is transported by the monorail conveyor to a washing and drying station with the parachute canopy mounted on the conveyor in a systematic arrangement which permits water and air to pass through the ribbon-like material of the canopy. Following drying of the parachute, the parachute is conveyed into an interior space where it is finally inspected and removed from the monorail conveyor and laid upon a table for folding. Following folding operations, the parachute is once again mounted on the conveyor in an elongated horizontal configuration and conveyed to a packing area for stowing the parachute in a depolyment bag.

4 Claims, 12 Drawing Figures

METHOD FOR REFURBISHING AND PROCESSING PARACHUTES

ORIGIN OF THE INVENTION

The invention described herein was made by an employee of the United States Government and may be manufactured and used by or for the Government for governmental purposes without the payment of any royalites thereon or therefor.

This is a division of application Ser. No. 862,878 filed Dec. 12, 1977 and now U.S. Pat. No. 4,224,810.

BACKGROUND OF THE INVENTION

The problems involved in handling very heavy, bulky and large parachutes such as those used in the space program require considerable attention. Parachutes ranging from 50 to 115 feet in diameter are commonly used which may weigh up to one and a half thousand pounds dry and two and a half thousand pounds wet making it extremely difficult to wash, dry, repair and pack the parachutes for reuse. Heretofore, parachute buildings have been utilized having vertical towers wherein the parachute is hung for refurbishing operations such as drying and washing. The flow of the refurbishing process goes from a horizontal transport at the receiving end through a vertical flow up and down the tower and then back to horizontal for inspecting and folding the parachute at the end of the process. Major parachute handling requirements and problems exist at each interface.

SUMMARY OF THE INVENTION

It has been found that a system and method for refurbishing and processing a ribbon parachute of the type having a canopy which includes a plurality of gore sections with radial lines delineating between adjacent gores terminating in a common apex portion. The system and method are provided by arranging the parachute canopy in a partially-open tented configuration for defouling and inspection beneath a section of an overhead conveyor. The overhead conveyor is provided by a monorail conveyor system having a horizontal conveyance path. The parachute is suspended from the monorail in a systematic arrangement for transport to a washing station wherein the parachute canopy is washed. Without changing the arrangement of the parachute, it is conveyed to a drying station wherein the parachute canopy is dried. A folding station is provided wherein the canopy is inspected as it is removed from the conveyor and reconditioned and folded with the suspension lines tacked. The parachute is then ready for packing into a deployment bag and is raised to the monorail and conveyed to the packing area. Assembly line processing is afforded for large heavy parachutes having diameters of 50, 115 feet and more by sequentially conveying the parachute canopy suspended in a predetermined arrangement in a horizontal path to the washing, drying, folding and packing stations.

Accordingly, an important object of the invention is to provide a system and method for refurbishing and processing parachutes wherein the parachute is mounted on an overhead conveyor system permitting a horizontal operation wherein the parachute is transported easily through any and all major processing stations with a high degree of mobility.

Another important object of the present invention is to provide a system and method for refurbishing parachutes wherein the parachute is mounted on an overhead conveyor in prescribed hanging patterns affording effective processing at each of the separate operational stations.

Still another important object of the present invention is to provide a system and method for refurbishing parachutes wherein the canopy of the parachute may be opened for inspection without requiring a large structure or space for supporting and housing the parachute.

Yet another important object of the present invention is the provision of a system and method for refurbishing and processing parachutes wherein all of the processing stations are connected by a overhead monorail conveyor in a horizontal path affording assembly line processing for parachutes.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
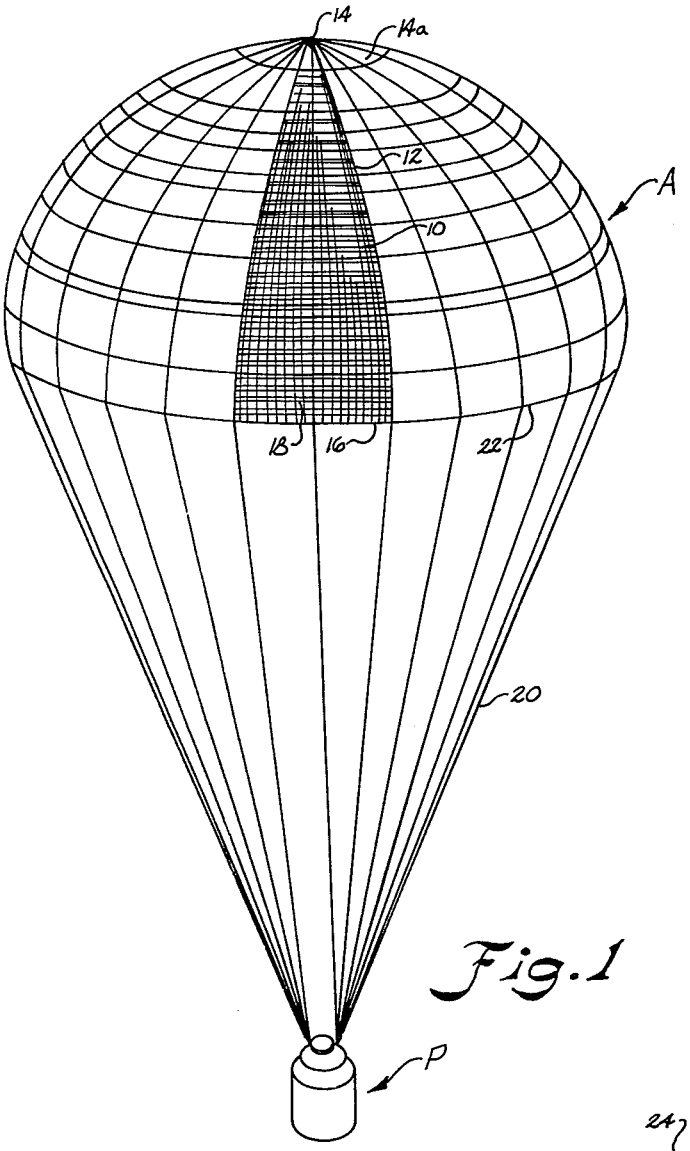
FIG. 1 illustrates a parachute of the ribbon type construction which may be refurbished and processed in accordance with the system and method of the present invention.

The invention relates to the refurbishing and processing of parachutes once they have been recovered after their operational use. In particular, the invention relates to refurbishing ribbon parachutes of the type having a canopy A which includes a plurality of gore sections 10 with radial lines 12 delineating between adjacent gore sections. The radial lines can be traced starting at the skirt 22 through the canopy gores 10 to the vent 14*a* at the apex 14 of the parachute and then back to the skirt. The canopy is completed by a plurality of spaced horizontal ribbon strips 16 which extend circumferentially of the canopy and a plurality of vertical ribbons 18 which are bound with the horizontal ribbon strips 16 to make up the canopy material. Suspension lines 20 are then connected to the skirt 22 of the canopy at each radial line with the ends of the suspension lines 20 being connected to the payload P.

Figure 2:
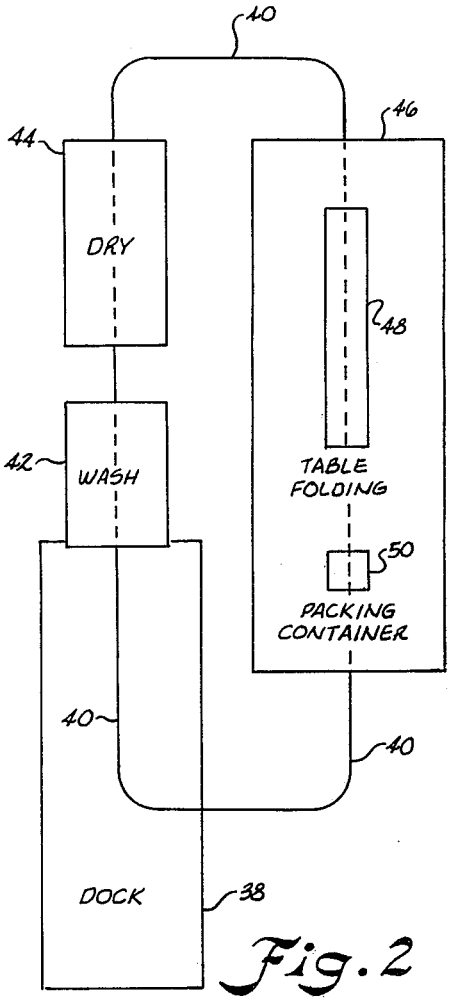
FIG. 2 is a flow diagram of the system and method of the present invention for refurbishing and processing parachutes.

The different steps in the refurbishing and processing of the parachutes are illustrated in the block diagram of FIG. 2 wherein the parachute undergoes an unloading sequence 24 which normally involves unreeling the parachute from a spool. Next, the parachute undergoes a defouling and tenting operation 26 wherein a worker may walk around and into the canopy to remove debris and inspect it for damage. Untangling of the canopy and suspension lines is also carried out in this operation. After the initial procedures of unloading and defouling, the parachute then undergoes a monorail mounting sequence 28 whereupon it is transported for a washing sequence 30 and a drying sequence 32. Following drying, the parachute is conveyed to an interior space where it undergoes a final inspection, repair and folding procedure at 34 and is then mounted on the monorail and conveyed to the packing area 36 for stowing into a deployment bag 50.

Figure 3:
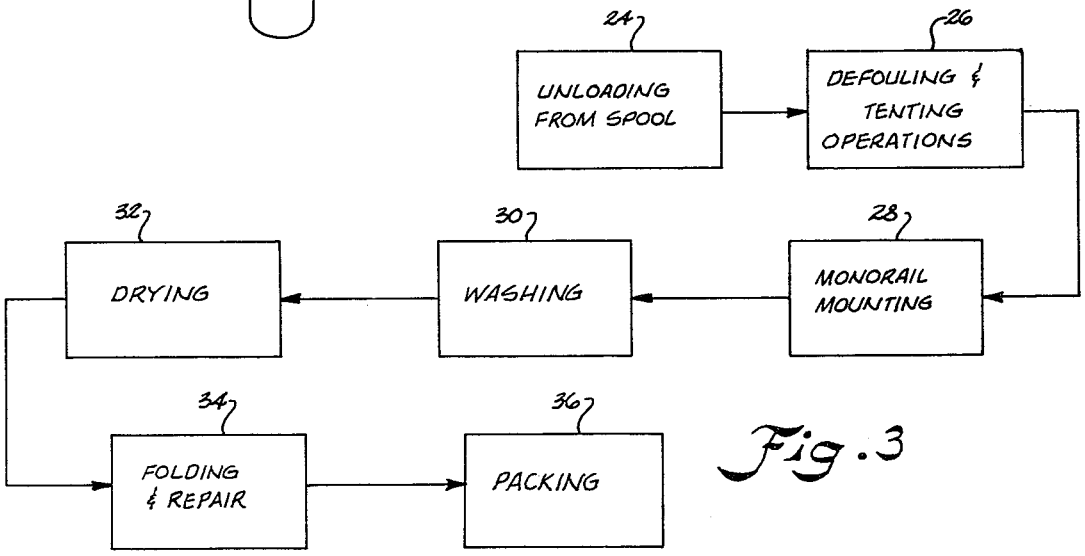
FIG. 3 is a schematic illustration of the different working stations in the system and method of the present invention.

FIG. 3 illustrates the various working stations of the system and method of refurbishing and processing a parachute in accordance with various sequences described above and illustrated in block diagram form in FIG. 2. A forklift is normally used in the unloading sequence 24 to unload the spool upon which the parachute is wound from a truck to a dock 38. The parachute is then unrolled from the spool underneath a section 40*a* of a monorail conveyor 40. The parachute canopy is suspended on the conveyor section 40*a* in a manner to be more fully hereinafter explained, for the initial defouling and tenting operations 26. The monorail conveyor extends through the washing station 42, the drying station 44 for accomplishing the drying sequence 32 and then makes entrance into the interior of a building 46 for the folding and repair sequence 34. During the folding and repair sequence 34, the parachute passes over a folding table 48 or floor folding area. The parachute is removed from the monorail over the table 48 and folded whereupon it is again mounted on the monorail conveyor in a folded configuration for the packing sequence 36 which results in the parachute being properly packed in the deployment bag 50.

Figure 4:
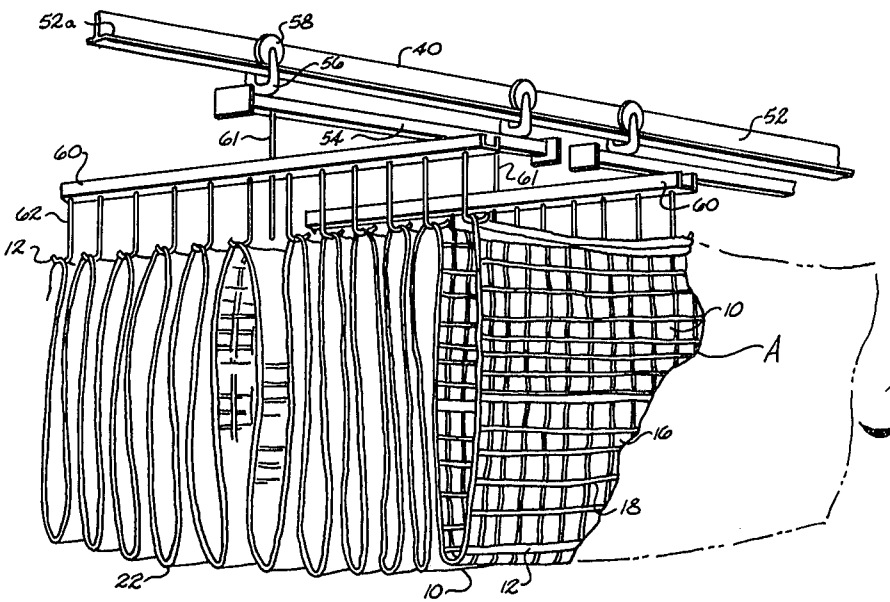
FIG. 4 is a perspective view of a section of an overhead monorail conveyor which is utilized in accordance with the system and method of the present invention for transporting the canopy of a parachute in a systematic arrangement.

In FIG. 4, the monorail conveyor is illustrated as including a single rail member 52 upon which a parallel rail 54 is mounted by way of U-shaped brackets 56 and rollers 58 which roll on horizontal flanges 52*a* of the rail 52. A plurality of transverse hanger bars 60 are secured to the rail 54 by means of screw bolts 61. Each hanger bar 60 includes a plurality of hanger hooks 62 depending downwardly therefrom in the form of elongated J-bolts which are secured to the hanger bar 60 by means of suitable nut members. The hanger bars and hooks provide attachment means by which the parachute canopy and suspension lines are attached to the monorail conveyor for suspending the canopy in the different systematic arrangements.

The individual rails 54 and the number of bars may be varied as required by the size of the parachute being processed. The conveyor rail or rails so provided may be manually rolled over the monorail 52 or a power drive may be provided.

Figure 5:
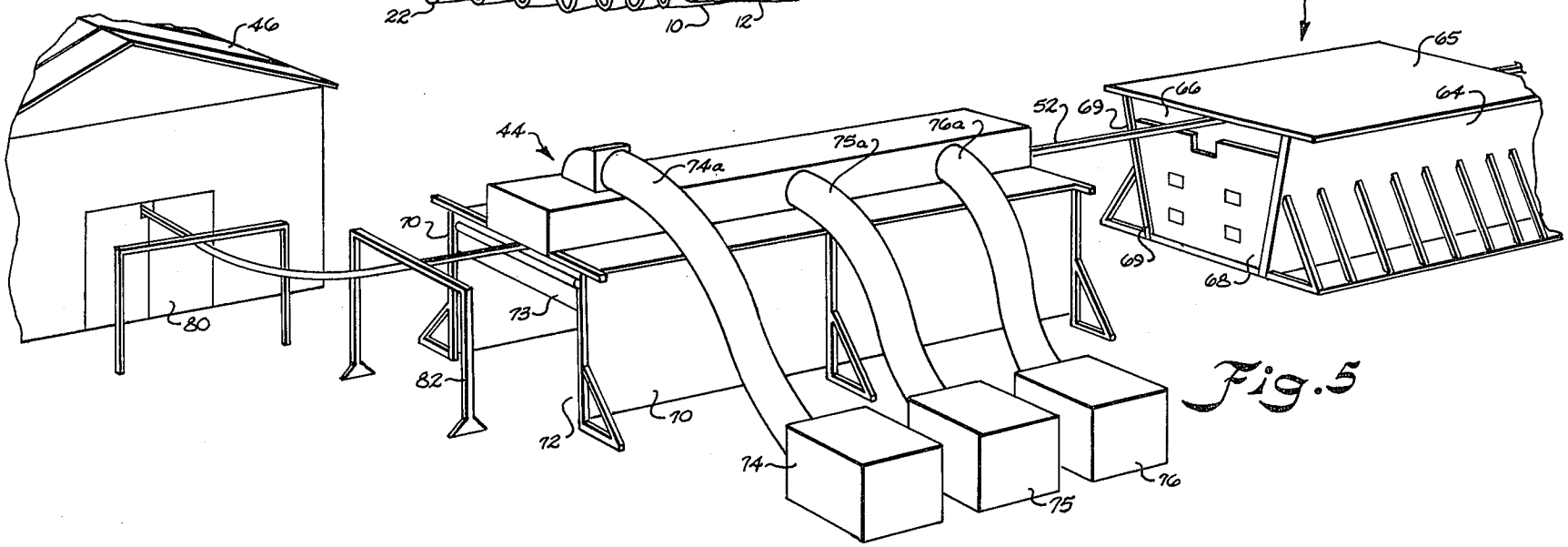
FIG. 5 is a perspective view of a washing station, a drying station and a folding and packaging station as utilized in accordance with the system and method of the present invention.

In FIG. 5, the washing station 42 can be provided by a vat structure having side walls 64 which diverge upwardly terminating at and supporting a flat rooftop 65. The ends of the washing vat 66 are provided with hinged door members 68 which are also tapered outwardly in the upward direction so as to fit in the space defined between the side walls 64. The end doors 68 are lifted upwardly in order to swing open about hinges 69 and are closed by swinging the door flush with the side walls 64 and dropping it to the bottom providing a watertight closure at each end of the washing vat. With the parachute canopy enclosed in the washing vat, water may be delivered in any suitable manner such as by spray nozzles along the length of the vat in any suitable arrangement. During the washing, salt accumulated from the saltwater in which the parachute has landed will be removed as well as any other foreign matter.

The monorail conveyor then extends through the drying station 44 which includes side walls 70 and two open ends that are closed during the drying period with a drop curtain 73. A plurality of blowers 74, 75, and 76 are provided which are connected by way of tubular ducts 74*a*, 75*a* and 76*a* into a common manifold outlet 78. The manifold outlet with adjustable openings at the bottom delivers the air from the blowers which is heated downward through the canopy material for drying. The monorail 52 then enters a pair of swinging doors 80 of the building structure 46 which houses the inspecting, repairing, folding, and packing operations. It will be noted that the monorail 52 is supported as required by overhead frame members 82 spaced along the conveyance path. If desired to have a portable installation, the entire system can be supported by these frame members 82.

Figure 6:
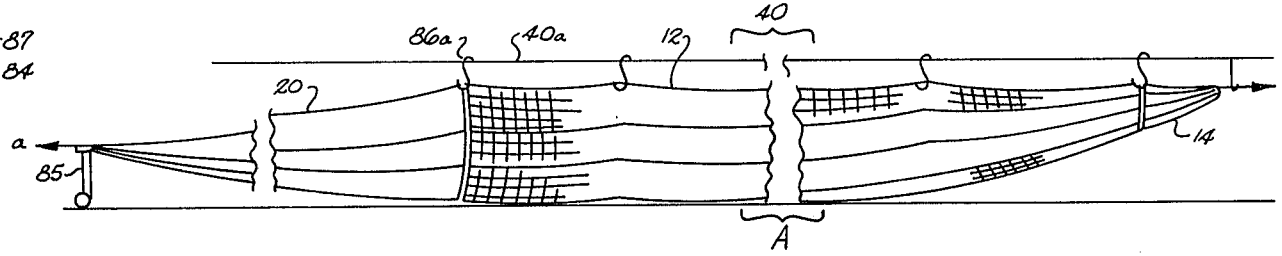
FIG. 6 is a schematic side elevational view of a parachute canopy suspended in a tented configuration for defouling and inspection operations in accordance with the present system and method.
Figure 7:
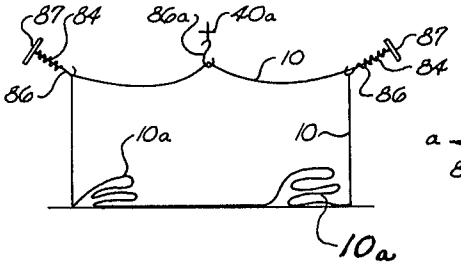
FIG. 7 is an end view of the parachute canopy as suspended in FIG. 6 illustrating the partially-open tented configuration of the canopy.

FIGS. 6 through 11 illustrate the systematic arrangement of the parachute on the monorail conveyor 40 during the various refurbishing processes. For the initial defouling and inspection operations, the parachute is suspended in a partially-open tented configuration as best seen in FIGS. 6 and 7. In this configuration, certain ones of the gore sections 10 are spread out and suspended enabling a worker to walk around and into the canopy for inspection. The remaining gore sections remain folded at 10*a* while the open gore sections are inspected. Releasable means for releasably suspending the canopy are provided by any suitable means such as elastic shock cord members 84 having end hooks 86. As seen in FIG. 7, the shock cord is attached to a support structure 87 and the hooks 86 to radial lines 12 of the canopy. Additional hooks 86*a* may be attached to the section 40*a* of the monorail conveyor and to another radial line 12 forming the tent. The releasable shock cords 84 and hooks 86 and 86*a* enable the suspended gore sections to be readily detached and rotated and replaced by a folded gore section 10*a* so that the entire canopy may be inspected and defouled by rotatably viewing certain ones of the gore sections at a time requiring only a limited amount of space.

During defouling and inspection, it is contemplated that the canopy A and the trailing suspension lines 20 be placed under tension in the horizontal direction of arrow "a". This keeps the canopy and lines taut enabling more expedient untangling and inspection of the parachute. For this purpose, the free ends of the lines 20 may be attached to a common bar or dolly 85 which is then drawn out by any suitable stretching devices such as a rachet operated winch until a desired tension is placed on the canopy and lines.

Figure 8:
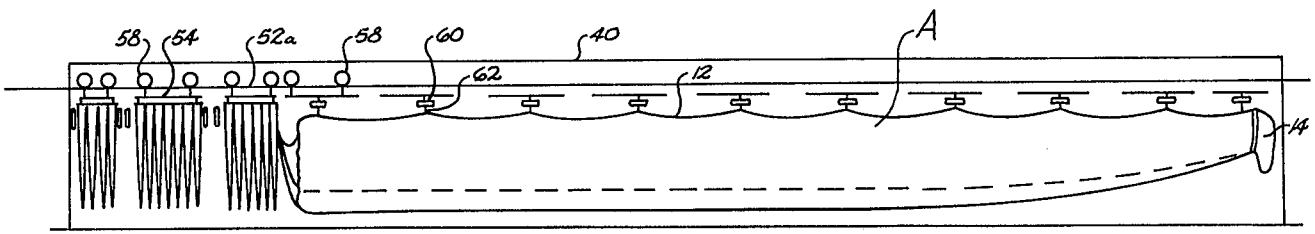
FIG. 8 is a schematic side elevational view of a parachute suspended from a monorail conveyor in a systematic arrangement for washing and drying operations in accordance with the present invention.
Figure 8A:
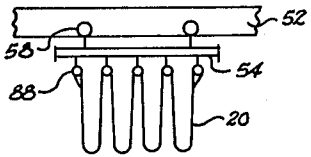
FIG. 8*a* is a schematic view illustrating the mounting of the suspension lines on the conveyor.
Figure 9:
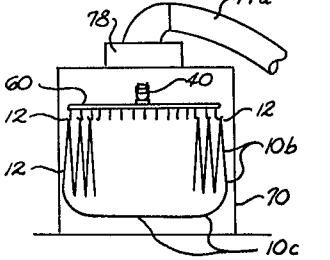
FIG. 9 is an end view of the canopy as suspended in FIG. 8.

FIGS. 8 and 9 illustrate the systematic arrangement of the canopy and suspension lines on the monorail conveyor 40 during the washing and drying operations which permits the water and air to flow through the ribbon-like material of the canopy in a highly effective manner. In this arrangement, the canopy is attached to the monorail by means of the hanger hooks 62 at different points along the length of certain ones of the radial lines 12. In the illustrated arrangement, the canopy is suspended by hanging every fifth radial line on a hanger hook 62 providing a two-gore hanging arrangement where two gore sections depend on either side of each hook. Thus, the outermost sides of the suspended canopy consist of two gore sections 10*b* depending on either side from the outermost hooks 62 and two bottom gore sections 10*c* extended underneath the depending gore sections. Of course, it is to be understood that other hanging arrangements may be had as defined by the relationship $n=2G+1$ where n is the repetitive number of radial lines which are attached and G is the desired number of gore sections depending on either side of the point of attachment. Thus, as illustrated, n is equal to 5 and G is equal to 2. The particular arrangement of a two-gore hang ($G=2$) has been found to provide a good arrangement for clearance of the washing and drying buildings and effective washing and drying. It will be noted that the canopy is illustrated as being transported on the monorail conveyor 40 with the apex portion 14 being conveyed forwardmost. As seen in FIG. 8*a*, the suspension lines may be hung or draped over transverse rods 88 in any suitable arrangement which are carried by a section of rail 54 trailing the canopy.

Figure 10:
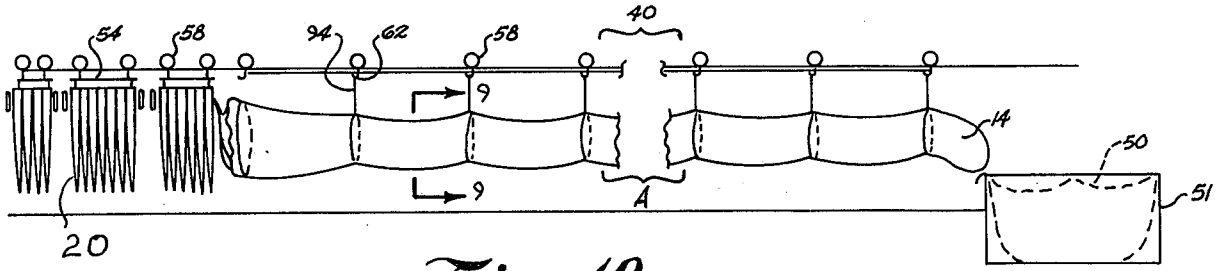
FIG. 10 is a schematic side elevational view of a parachute canopy suspended in a folded configuration from a monorail conveyor in accordance with the present invention.
Figure 11:
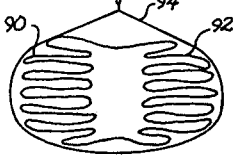
FIG. 11 is a sectional view taken on the line 11—11 of FIG. 10.

Following washing and drying operations, the canopy A is conveyed over the folding table 48 or floor folding area whereupon it is removed from the monorail conveyor and folded in a suitable arrangement for packaging in the deployment bag 50. FIG. 11 illustrates a preferred form for the folding of the canopy whereby the gore sections are folded in two stacks of folds 90 and 92. Following folding in this manner, the canopy is harnessed by a plurality of straps 94 which encircle the folded canopy and are attached to the monorail conveyor by means of the hanger hooks 62 as shown in FIG. 10. The folded canopy and the trailing suspension lines 20 are conveyed forward and the canopy is removed as it approaches the packing container 51 and packed into the deployment bag 50 therein. The suspension lines 20 trail the canopy and are packaged in a like manner.

As an alternate step in the refurbishing and processing system and method, the parachute may be arranged in the tented configuration similar to FIGS. 6 and 7 prior to being removed from the monorail and folded. This is for the purpose of making a final inspection and making minor repairs such as sewing and stitching of the material of the parachute which may need repair. During this time, the suspension lines and canopy are placed under tension in the longitudinal or horizontal direction as heretofore discussed.

Thus it can be seen that an advantageous system and method for refurbishing and processing parachutes can be had in accordance with the present invention whereby parachute mobility is achieved during the refurbishing process so that the parachute may be transported easily to any and all major processing stations. The systematic arrangement of the parachute on the monorail conveyor provides effective washing and drying operations as well as providing unique inspection of the rather large canopy in a limited amount of space. The tenting operation enables the large canopy to be opened in parts so that the workers may walk around and inside the canopy for defouling, inspection and repair. The monorail is a conveyance system which extends through all of the major processing stations which permit continuous assembly line processing of the parachutes.

While a preferred embodiment of the invention has been described using specific terms, such description is for illustrative purposes only, and it is to be understood that changes and variations may be made without departing from the spirit or scope of the following claims.

What is claimed is:

1. A method for refurbishing and processing a parachute of the type having a canopy including a plurality of gore sections with radial lines delineating between adjacent gore sections extending through a common point to define an apex portion comprising the steps of:

(a) arranging said parachute canopy in a partially-open tented configuration for defouling and inspection thereof;

(b) providing an overhead conveyor;

(c) suspending said parachute horizontally from said conveyor by attaching every nth radial line to said conveyor with said apex portion conveyed forwardmost where n is defined by $n=2G+1$, where G is the desired number of gore section depending from either side of the point of attachment to said conveyor;

(d) providing a washing station wherein said parachute is washed;

(e) providing a drying station wherein said parachute is dried;

(f) providing a folding station wherein said canopy is removed from said conveyor and folded for packing; and (g) sequentially conveying said parachute canopy suspended from said overhead conveyor in a generally horizontal path to said washing, drying and folding stations.

2. The method of claim 1 wherein said parachute canopy is arranged in said tented configuration by spreading and suspending certain ones of said gore sections while leaving other of said gore sections folded.

3. The method of claim 2 wherein said folded gore sections are rotated with said suspended gore sections until all of said folded gore sections have been opened and suspended for defouling and open inspection.

4. The method of claim 1 including remounting said canopy on said conveyor following folding thereof and conveying said parachute to a packing station wherein the parachute is packaged for deployment.

* * * * *